US010724225B2

(12) United States Patent
Brill et al.

(10) Patent No.: US 10,724,225 B2
(45) Date of Patent: Jul. 28, 2020

(54) SEMI-ROUND DRAIN BODY AND LINEAR DRAIN SYSTEM INCLUDING THE SAME

(71) Applicant: INFINITY DRAIN LTD., Amityville, NY (US)

(72) Inventors: Jonathan Brill, Amityville, NY (US); Alan Trink, Amityville, NY (US); Bhasnarine Ramkarran, Amityville, NY (US)

(73) Assignee: INFINITY DRAIN LTD., Amityville, NY (US)

( * ) Notice: Subject to any disclaimer, the term of this patent is extended or adjusted under 35 U.S.C. 154(b) by 64 days.

(21) Appl. No.: 15/994,609

(22) Filed: May 31, 2018

(65) Prior Publication Data

US 2019/0106874 A1 Apr. 11, 2019

Related U.S. Application Data

(60) Provisional application No. 62/571,042, filed on Oct. 11, 2017.

(51) Int. Cl.

| | |
|---|---|
| ***E03F 5/04*** | (2006.01) |
| ***E03C 1/22*** | (2006.01) |
| ***A47K 3/40*** | (2006.01) |
| ***E03F 3/04*** | (2006.01) |

(52) U.S. Cl.

CPC ..... *E03F 5/0408* (2013.01); *A47K 3/405* (2013.01); *E03C 1/22* (2013.01); *E03F 3/046* (2013.01); *E03F 2005/0415* (2013.01)

(58) Field of Classification Search

CPC . A47K 3/405; E03C 1/22; E03F 3/046; E03F 2005/0415

USPC ..... 4/680, 613; D23/261

See application file for complete search history.

(56) References Cited

U.S. PATENT DOCUMENTS

| | | | | |
|---|---|---|---|---|
| 4,146,939 A * | 4/1979 | Izzi | ..... | E03F 5/0409 4/286 |
| D739,507 S * | 9/2015 | Watson | ..... | D23/262 |
| 2003/0115814 A1* | 6/2003 | Nielsen | ..... | E03F 5/0406 52/302.1 |

FOREIGN PATENT DOCUMENTS

| | | |
|---|---|---|
| WO | 2007013822 | 1/2007 |

* cited by examiner

*Primary Examiner* — Janie M Loeppke

(74) *Attorney, Agent, or Firm* — F. Chau & Associates, LLC

(57) ABSTRACT

A semi-round drain body includes an upper surface and a drain hole extending through the upper surface. The upper surface includes a first straight edge, a second straight edge disposed opposite to the first straight edge, a first curved edge, and a second curved edge disposed opposite to the first curved edge. The drain hole is disposed between the first and second straight edges and between the first and second curved edges. The first curved edge connects a first end of the first straight edge and a first end of the second straight edge to each other, and the second curved edge connects a second end of the first straight edge and a second end of the second straight edge to each other.

18 Claims, 6 Drawing Sheets

SEMI-ROUND DRAIN BODY AND LINEAR DRAIN SYSTEM INCLUDING THE SAME

CROSS REFERENCE TO RELATED APPLICATIONS

This application claims priority to and the benefit of U.S. Provisional Application Ser. No. 62/571,042 filed on Oct. 11, 2017, the disclosure of which is herein incorporated by reference in its entirety.

TECHNICAL FIELD

Exemplary embodiments of the present invention relate to a semi-round drain body and a linear drain system including the semi-round drain body.

DISCUSSION OF THE RELATED ART

A linear drain system typically includes a round drain body installed in a floor, and a linear drain channel installed onto the drain body. The linear drain channel may be positioned, for example, along a structure such as a wall or the threshold of a shower enclosure. Due to the round shape of the drain body, a limitation may occur in which the round drain body and the linear drain channel cannot be installed as close to the edge of the structure as desired, as the round drain body creates a space between the structure and the round drain body, and as a result, between the structure and the linear drain channel installed onto the round drain body. This limitation may also occur with other types of floor drains (e.g., floor drains other than a linear drain channel) connected to the round drain body.

SUMMARY

According to an exemplary embodiment of the present invention, a semi-round drain body includes an upper surface and a drain hole extending through the upper surface. The upper surface includes a first straight edge, a second straight edge disposed opposite to the first straight edge, a first curved edge, and a second curved edge disposed opposite to the first curved edge. The drain hole is disposed between the first and second straight edges and between the first and second curved edges. The first curved edge connects a first end of the first straight edge and a first end of the second straight edge to each other, and the second curved edge connects a second end of the first straight edge and a second end of the second straight edge to each other.

According to an exemplary embodiment of the present invention, a linear drain system includes a linear drain channel and a semi-round drain body. The linear drain channel includes a first side, a second side opposing the first side, a third side, and a fourth side opposing the third side. The first side connects a first end of the third side and a first end of the fourth side to each other, and the second side connects a second end of the third side and a second end of the fourth side to each other. The first and second sides are longer than the third and fourth sides. The linear drain channel further includes a lower surface disposed between and connected to the first, second, third, and fourth sides, as well as a drain hole formed in the lower surface. The semi-round drain body is configured to attach to the linear drain channel. The semi-round drain body includes an upper surface and a drain hole extending through the upper surface. The upper surface includes a first straight edge, a second straight edge disposed opposite to the first straight edge, a first curved edge, and a second curved edge. The drain hole of the semi-round drain body is disposed between the first and second straight edges, and between the first and second curved edges. The first curved edge connects a first end of the first straight edge and a first end of the second straight edge to each other, and the second curved edge connects a second end of the first straight edge and a second end of the second straight edge to each other.

According to an exemplary embodiment of the present invention, a linear drain system includes a linear drain channel and a semi-round drain body. The linear drain channel includes a first side, a second side disposed substantially parallel to the first side, a third side, and a fourth side disposed substantially parallel to the third side. The first and second sides are longer than the third and fourth sides. The semi-round drain body is configured to attach to the linear drain channel, and includes an upper surface. The upper surface includes a first straight edge, a second straight edge disposed substantially parallel to the first straight edge, a first curved edge, and a second curved edge disposed opposite to the first curved edge.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EXEMPLARY EMBODIMENTS

Figure 1:
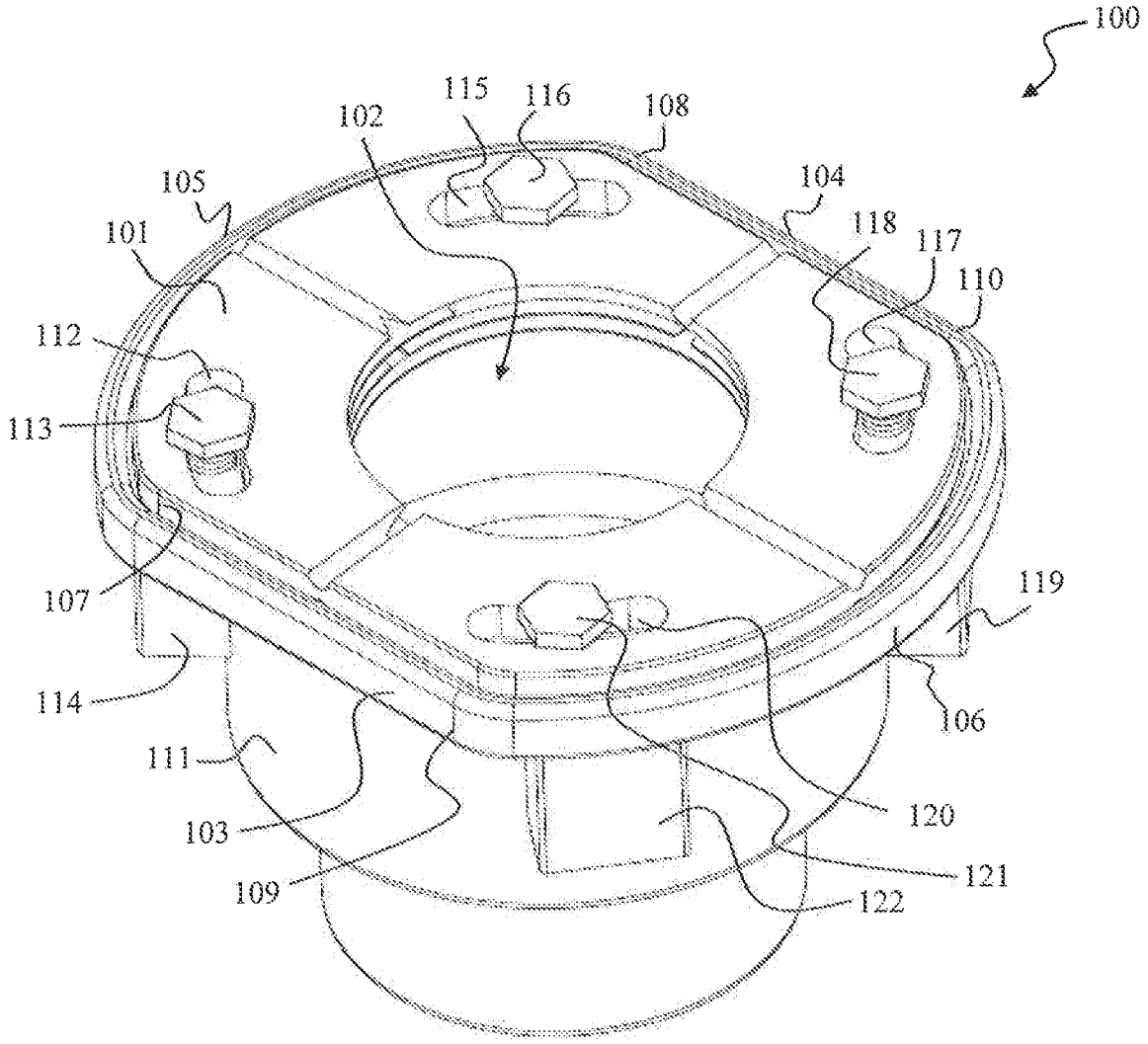
FIG. 1 is a perspective view of a semi-round drain body according to an exemplary embodiment of the present invention.

Exemplary embodiments of the present invention will be described more fully hereinafter with reference to the accompanying drawings. Like reference numerals may refer to like elements throughout the accompanying drawings.

Hereinafter, spatially relative terms, such as "beneath", "below", "lower", "under", "above", "upper", etc., may be used herein for ease of description to describe one element or feature's relationship to another element(s) or feature(s)

as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below.

It will further be understood that the terms "first," "second," "third," etc. are used herein to distinguish one element from another, and the elements are not limited by these terms. Thus, a "first" element in an exemplary embodiment may be described as a "second" element in another exemplary embodiment. In addition, when two or more values (e.g., a length, a width, a height, a distance, etc.) are described as being substantially the same as or about equal to each other, it is to be understood that the elements or values are identical to each other, indistinguishable from each other, or distinguishable from each other but functionally the same as each other as would be understood by a person having ordinary skill in the art.

Figure 2:
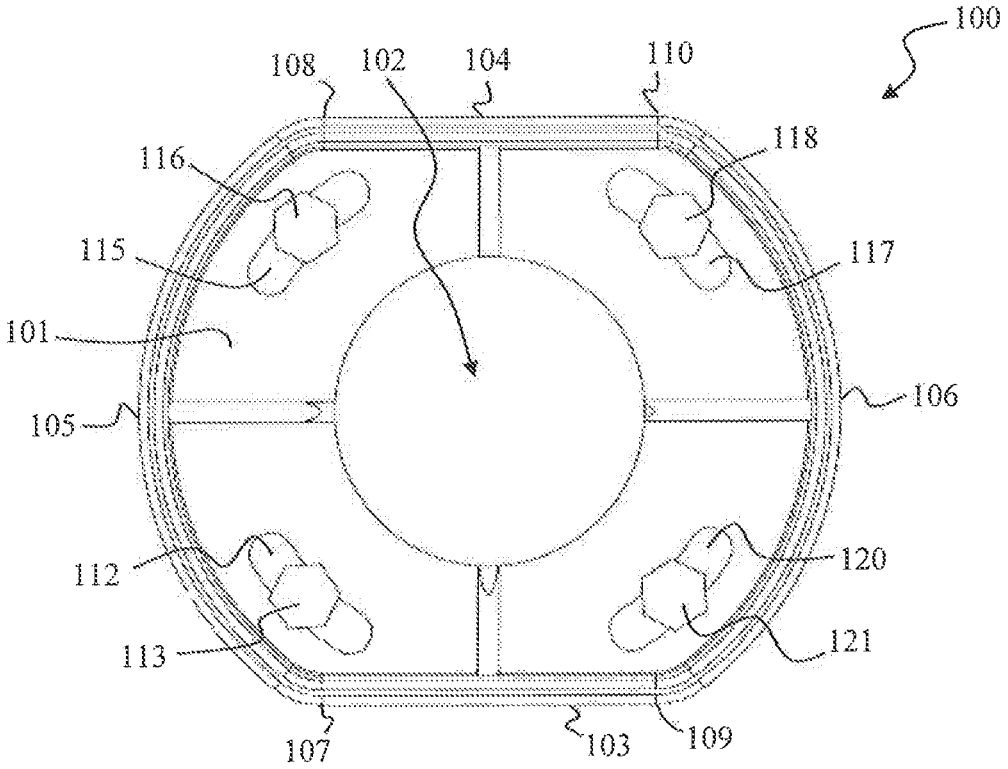
FIG. 2 is a top plan view of the semi-round drain body illustrated in FIG. 1 according to an exemplary embodiment of the present invention.
Figure 3:
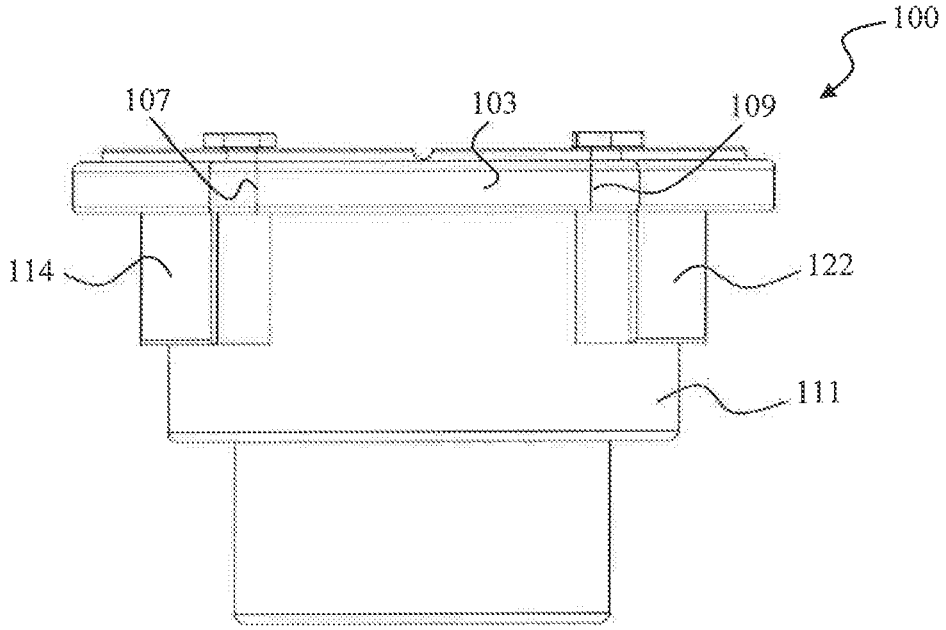
FIG. 3 is a side view of the semi-round drain body illustrated in FIG. 1 according to an exemplary embodiment of the present invention.
Figure 4:
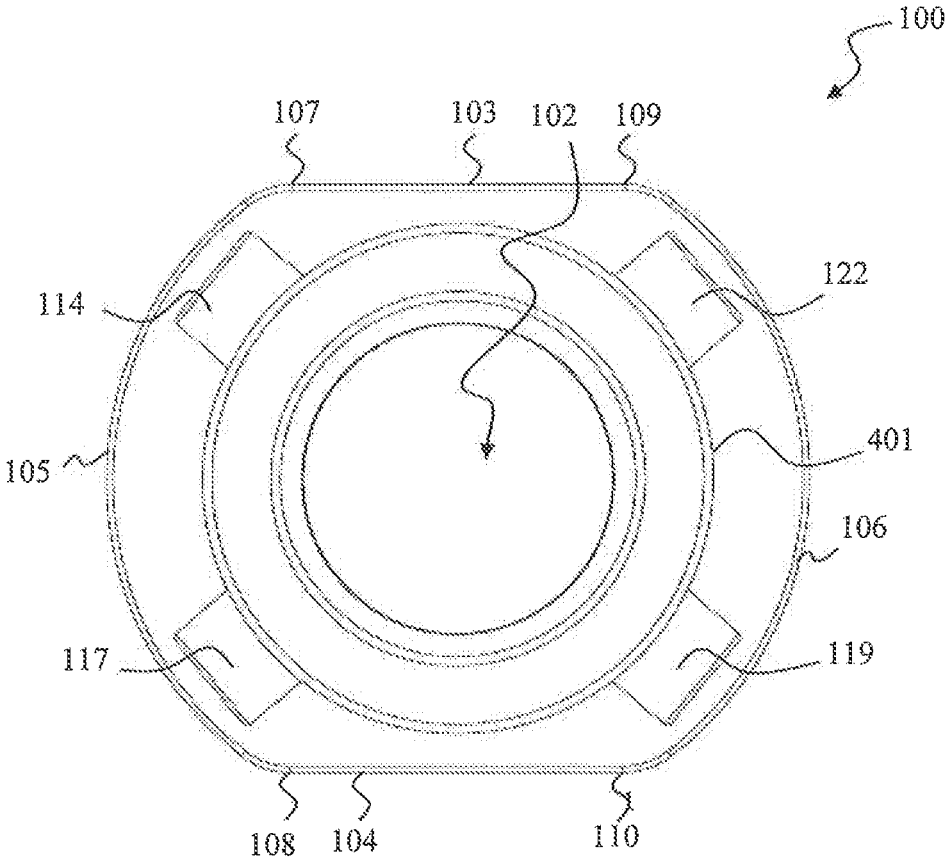
FIG. 4 is a bottom view of the semi-round drain body illustrated in FIG. 1 according to an exemplary embodiment of the present invention.
Figure 5:
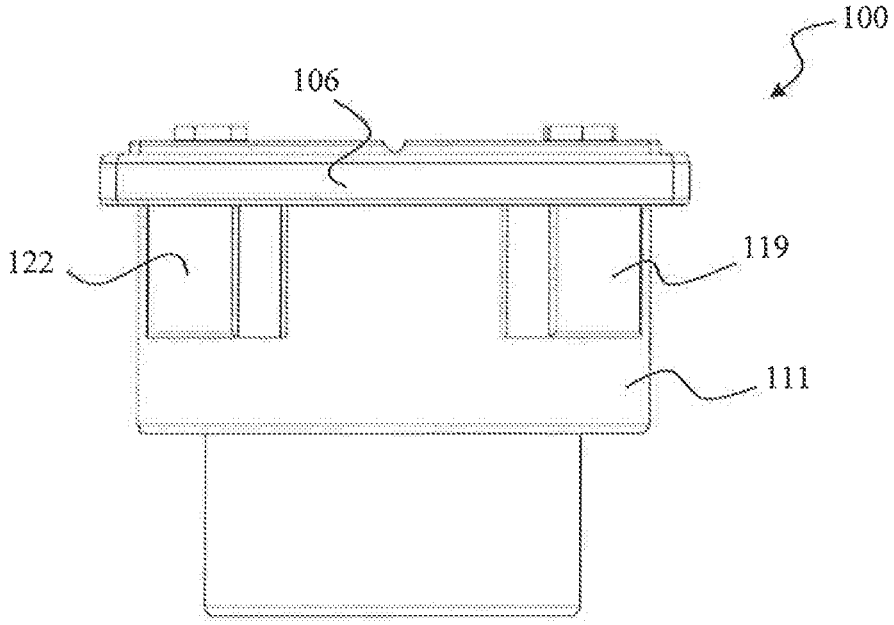
FIG. 5 is a side view of the semi-round drain body illustrated in FIG. 1 according to an exemplary embodiment of the present invention.
Figure 6:
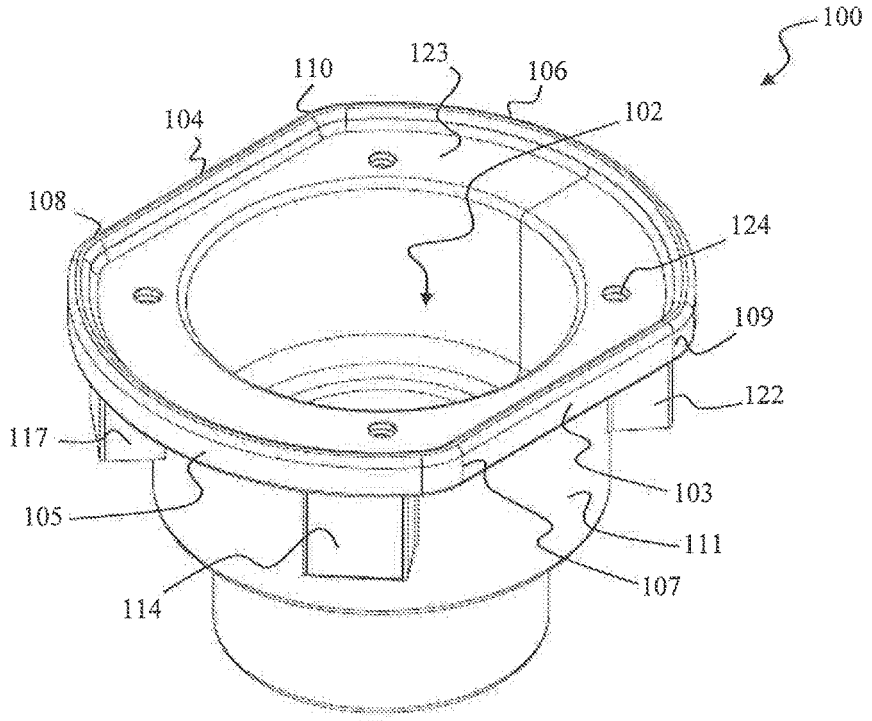
FIG. 6 is a perspective view of the semi-round drain body illustrated in FIG. 1 with a clamping plate removed according to an exemplary embodiment of the present invention.

FIG. 1 is a perspective view of a semi-round drain body according to an exemplary embodiment of the present invention. FIG. 2 is a top plan view of the semi-round drain body illustrated in FIG. 1 according to an exemplary embodiment of the present invention. FIG. 3 is a side view of the semi-round drain body illustrated in FIG. 1 according to an exemplary embodiment of the present invention. For example, FIG. 3 is side view taken from a side corresponding to a straight edge of an upper surface of the semi-round drain body illustrated in FIG. 1. FIG. 4 is a bottom view of the semi-round drain body illustrated in FIG. 1 according to an exemplary embodiment of the present invention. FIG. 5 is a side view of the semi-round drain body illustrated in FIG. 1 according to an exemplary embodiment of the present invention. For example, FIG. 5 is side view taken from a side corresponding to a curved edge of the upper surface of the semi-round drain body illustrated in FIG. 1. FIG. 6 is a perspective view of the semi-round drain body illustrated in FIG. 1 with a clamping plate removed according to an exemplary embodiment of the present invention.

Herein, a semi-round drain body may also be referred to as a semi-round clamp-down drain body. The semi-round drain body according to exemplary embodiments of the present invention may be, for example, a cast-iron semi-round drain body. Further, in exemplary embodiments, the semi-round drain body may be formed of, for example, acrylonitrile butadiene styrene (ABS) plastic, or polyvinyl chloride (PVC). However, the material used to form the semi-round drain body is not limited thereto.

Referring to FIGS. 1 to 6, in an exemplary embodiment of the present invention, a semi-round drain body 100 includes an upper surface 123 having a drain hole 102 that extends through the upper surface 123.

The upper surface 123 of the semi-round drain body 100 includes a first straight edge 103, a second straight edge 104, a first curved edge 105, and a second curved edge 106. The first straight edge 103 and the second straight edge 104 are disposed opposite to each other, with the drain hole 102 disposed therebetween. The first straight edge 103 and the second straight edge 104 are disposed opposite to each other and are substantially parallel to each other. For example, the first straight edge 103 and the second straight edge 104 may be exactly parallel to each other, or approximately parallel to each other within a measurement error as would be understood by a person having ordinary skill in the art. The first curved edge 105 and the second curved edge 106 are disposed opposite to each other, with the drain hole 102 disposed therebetween. The first curved edge 105 connects a first end 107 of the first straight edge 103 and a first end 108 of the second straight edge 104 to each other. The second curved edge 106 connects a second end 109 of the first straight edge 103 and a second end 110 of the second straight edge 104 to each other.

The semi-round drain body 100 further includes a base portion 111 connected to and extending from a bottom side of the upper surface 123. Together, the drain hole 102 and the base portion 111 form a through hole that extends through the entirety of the semi-round drain body 100. Water (or any other liquid) may pass through the through hole formed by the drain hole 102 and the base portion 111 to be drained through the semi-round drain body 100. The base portion 111 may have a circular shape that is shaped and dimensioned to connect to, for example, a pipe that the semi-round drain body 100 is to be connected to, allowing water (or any other liquid) to be drained through the semi-round drain body 100 and the connected pipe.

In an exemplary embodiment, a clamping plate 101 is attached to the upper surface 123 using fasteners (e.g., screws, bolts, etc.). A sealing material (e.g., a shower pan liner) may be disposed between the clamping plate 101 and the semi round drain body 100, thereby creating a waterproof seal when the clamping plate 101 is clamped down onto the semi-round drain body 100 with the sealing material (e.g., the shower pan liner) disposed therebetween.

As shown in FIG. 6, in an exemplary embodiment, the first and second straight edges 103 and 104 and the first and second curved edges 105 and 106 of the upper surface 123 extend upward from the upper surface 123, forming a lip. The clamping plate 101 may be shaped and dimensioned to fit within this lip (see, e.g., FIGS. 1 and 6). Thus, similar to the upper surface 123 of the semi-round drain body 100, the clamping plate 101 includes first and second straight edges and first and second curved edges, which respectively correspond to the first and second straight edges 103 and 104 and the first and second curved edges 105 and 106 of the upper surface 123. The clamping plate 101 is sized such that it fits within the lip of the upper surface 123 of the semi-round drain body 100 formed by the first and second straight edges 103 and 104 and the first and second curved edges 105 and 106.

In an exemplary embodiment, a first fastener opening 112, a second fastener opening 115, a third fastener opening 117, and a fourth fastener opening 120 are formed in the clamping plate 101. The first to fourth fastener openings 112, 115, 117 and 120 are shaped and dimensioned to respectively receive a first fastener 113, a second fastener 116, a third fastener 118, and a fourth fastener 121 to secure the clamping plate 101 to the semi-round drain body 100. First to fourth fastener receiving cavities 114, 117, 119 and 122 are disposed below and extend from the bottom side of the upper surface 123. The first to fourth fastener receiving cavities 114, 117, 119 and 122 are respectively aligned with the first to fourth fastener openings 112, 115, 117 and 120 when the clamping plate 101 is attached to the upper surface 123. The first to fourth fastener receiving cavities 114, 117, 119 and 122 are respectively configured to secure the first to fourth fasteners 113, 116, 118, and 121 therein. For example, when the first to fourth fasteners are threaded fasteners (e.g., a threaded bolt or screw), the fastener receiving cavities may be correspondingly threaded to secure the fasteners therein. To secure the clamping plate 101 to the semi-round drain body 100, the first to fourth fasteners 113, 116, 118, and 121 are respectively inserted through the first to fourth fastener openings 112, 115, 117 and 120 formed in the clamping plate 101, through fastener holes 124 (see FIG. 6) formed in the upper surface 123 of the semi-round drain body 100, and into the first to fourth fastener receiving cavities 114, 117, 119 and 122.

In an exemplary embodiment, the first fastener receiving cavity 114 is disposed in an area between the first end 107 of the first straight edge 103 and the center of the first curved edge 105, the second fastener receiving cavity 117 is disposed in an area between the first end 108 of the second straight edge 104 and the center of the first curved edge 105, the third fastener receiving cavity 119 is disposed in an area between the second end 110 of the second straight edge 104 and the center of the second curved edge 106, and the fourth fastener receiving cavity 122 is disposed in an area between the second end 109 of the first straight edge 103 and the center of the second curved edge 106. In addition, the first and second fastener receiving cavities 114 and 117 are disposed between an outer circumference 401 of the base portion 111 and the first curved edge 105, and the third and fourth fastener receiving cavities 119 and 122 are disposed between the outer circumference 401 of the base portion 111 and the second curved edge 106.

The semi-round drain body 100 according to exemplary embodiments of the present invention provides improvements over a conventional drain body, which is fully round. For example, because a conventional drain body is fully round, a limitation may occur in which the conventional drain body cannot be installed as close to the edge of a structure such as, for example, a wall or the threshold to a shower enclosure, as desired. Due to the semi-round shape of the semi-round drain body 100 according to exemplary embodiments of the present invention, the semi-round drain body 100 may be placed closer to such a structure compared to a conventional drain body. For example, one of the first and second straight edges 103 and 104 of the semi-round drain body 100 may be placed against such a structure, whereas due to the fully round shape of a conventional drain body, the conventional drain body cannot be placed as close to such a structure as compared to the semi-round drain body 100. In addition, due to the semi-round shape of the semi-round drain body 100, the overall size and footprint of the semi-round drain body 100 may be smaller than that of a comparable conventional fully round drain body. The ability to install the semi-round drain body 100 closer to a structure such as a wall or the threshold to a shower enclosure, as well as the reduced footprint of the semi-round drain body 100 compared to that of a conventional drain body, may provide improvements relating to the efficiency of drainage in certain environments, and may also provide the benefit of giving an installer more options regarding the placement of the semi-round drain body 100.

Further, the positions of the first to fourth receiving cavities 114, 117, 119 and 122 as described above also results in allowing fix the semi-round drain body 100 to be placed closer to a structure such as a wall or the threshold to a shower enclosure. For example, by positioning the first to fourth receiving cavities 114, 117, 119 and 122 in areas between ends of the straight edges and center portions of the curved edges, and between the outer circumference 401 of the base portion 111 and the curved edges, as described above, the first to fourth receiving cavities 114, 117, 119 and 122 allow for the clamping plate 101 to be securely attached to the upper surface 123 while not interfering with the ability to place the first and second straight edges 103 and 104 closely against the structure.

According to exemplary embodiments of the present invention, the semi-round drain body 100 may be used in a linear drain system in conjunction with a linear drain channel, as described below with reference to FIGS. 7-9.

A linear drain channel is an elongated drain channel that may be positioned, for example, along a wall or along the threshold of a shower enclosure. A linear drain channel is installed onto a drain body that is installed in a floor. Exemplary embodiments of the present invention may be utilized with a variety of linear drain systems. For example, exemplary embodiments may be utilized with a linear drain system having a wedge wire system, a perforated drain system, or a tile insert system. However, exemplary embodiments are not limited thereto, FIG. 7 is a top plan view of a linear drain system including a linear drain channel according to an exemplary embodiment of the present invention. FIG. 8 is a perspective exploded view of the linear drain system illustrated in FIG. 7 according to an exemplary embodiment of the present invention. FIG. 9 is a perspective view of the linear drain system illustrated in FIG. 7 according to an exemplary embodiment of the present invention.

Figure 7:
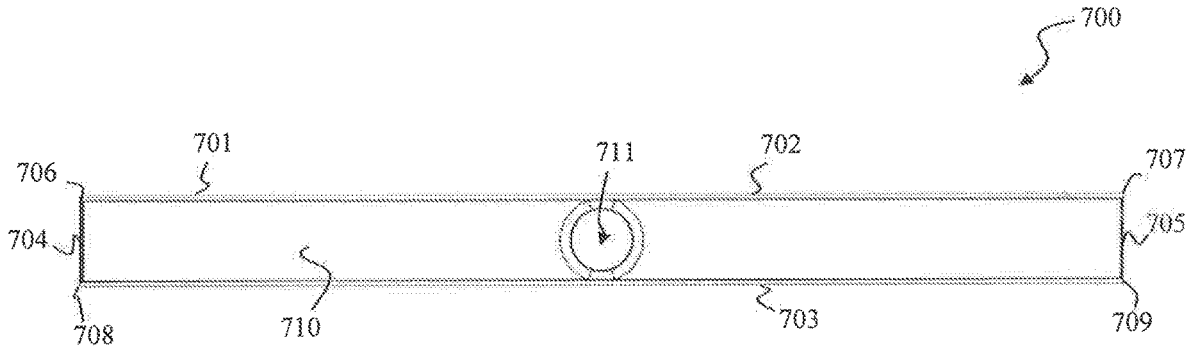
FIG. 7 is a top plan view of a linear drain system according to an exemplary embodiment of the present invention.
Figure 8:
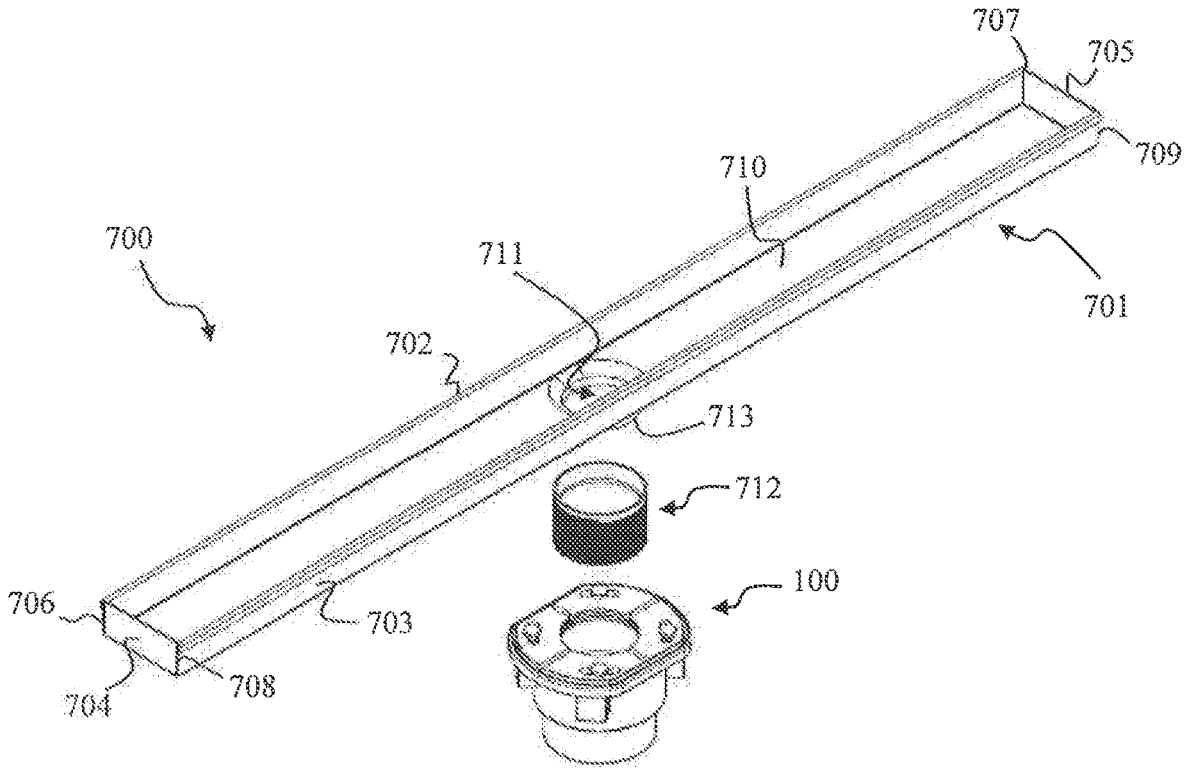
FIG. 8 is a perspective exploded view of the linear drain system illustrated in FIG. 6 according to an exemplary embodiment of the present invention.
Figure 9:
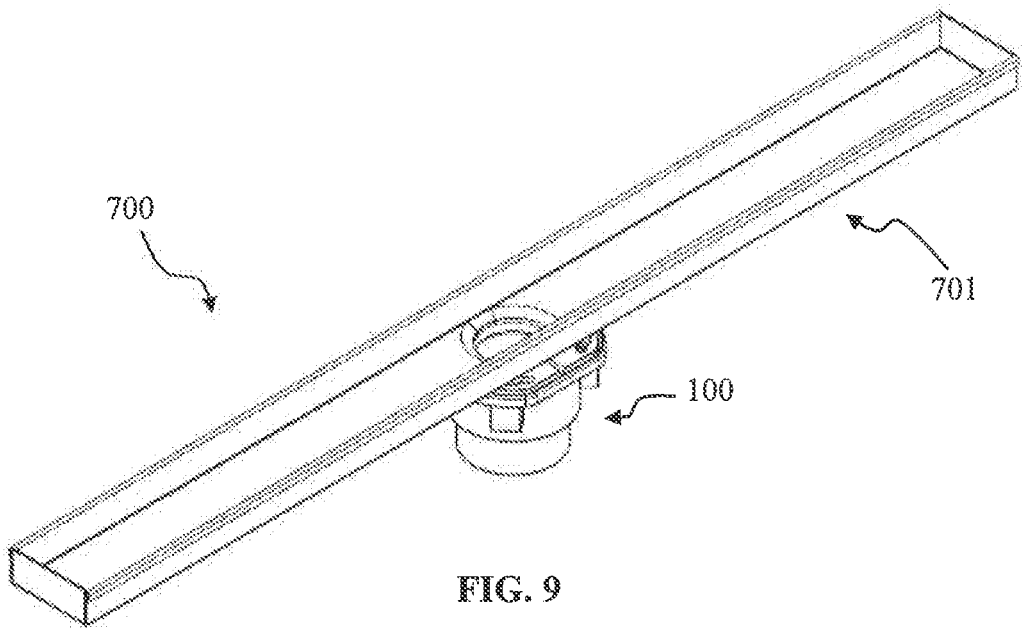
FIG. 9 is a perspective view of the linear drain system illustrated in FIG. 6 according to an exemplary embodiment of the present invention.

Referring to FIGS. 7-9, in an exemplary embodiment, a linear drain system 700 includes a linear drain channel 701 and the semi-round drain body 100. The linear drain channel 701 includes a first side 702, a second side 703 opposing the first side 702, a third side 704, and a fourth side 705 opposing the third side 704. The first and second sides 702 and 703 are substantially parallel to each other. For example, the first and second sides 702 and 703 may be exactly parallel to each other, or approximately parallel to each other within a measurement error as would be understood by a person having ordinary skill in the art. The third and fourth sides 704 and 705 are substantially parallel to each other. For example, the third and fourth sides 704 and 705 may be exactly parallel to each other, or approximately parallel to each other within a measurement error as would be understood by a person having ordinary skill in the art. As shown in FIGS. 7-9, the first side 702 connects a first end 706 of the third side 704 and a first end 707 of the fourth side 705 to each other, and the second side 703 connects a second end 708 of the third side 704 and a second end 709 of the fourth side 705 to each other. The linear drain channel 701 is an elongated drain channel. For example, the first and second sides 702 and 703 are longer than the third and fourth sides 704 and 705.

A lower surface 710 is disposed between and connected to the first to fourth sides 702-705. The first to fourth sides 702-705 extend upward from the lower surface 710, thus forming a drain channel. A drain hole 711, through which water (or any other liquid) may be drained, is formed in the lower surface 710.

The semi-round drain body 100 illustrated in FIGS. 7-9 is the same semi-round drain body 100 described in detail with reference to FIGS. 1-6. Thus, for convenience of explanation, a further description of elements and functions of the semi-round drain body 100 previously described with reference to FIGS. 1-6 may be omitted herein.

The semi-round drain body 100 is configured to attach to the linear drain channel 701. For example, in an exemplary embodiment, an outlet 712 attaches the semi-round drain body 100 to the linear drain channel 701. The outlet 712 and the drain hole 102 of the semi-round drain body 100 may both be threaded, and the outlet 712 may attach to the semi-round drain body 100 via a threaded connection. For example, the outer surface of the outlet 712 may be threaded, the inner surface of the drain hole 102 may be threaded, and the outlet 712 may be shaped and dimensioned to fit within the drain hole 102 to be connected to the semi-round drain body 100 via a threaded connection. When the outlet 712 attaches the semi-round drain body 100 to the linear drain channel 701, the drain hole 711 of the linear drain channel 701, an opening of the outlet 712, and the drain hole 102 of the semi-round drain body 100 form a through hole (e.g., a complete opening) that allows water (or any other liquid) to be drained through the linear drain channel 701, the outlet 712, and the semi-round drain body 100 and into a pipe connected to the semi-round drain body 100.

The linear drain channel 701 and the outlet 712 may be formed of, for example, stainless steel. However, the material of the linear drain channel 701 and the outlet 712 is not limited thereto.

In an exemplary embodiment, when the semi-round drain body 100 is utilized with the linear drain channel 701, the semi-round drain body 100 is installed into a floor to connect to a pipe, the outlet 712 is inserted into the drain hole 102 of the semi-round drain body 100 to be attached to the semi-round drain body 100, as described above, and the linear drain channel 701 is installed in the floor and onto the semi-round drain body 100, as shown in FIGS. 8 and 9. For example, the linear drain channel 701 may include a protruding portion 713 (see FIG. 8) extending from the drain hole 711 that is shaped and dimensioned to be placed into the opening of the outlet 712. The linear drain channel 701 may be installed into the floor by creating a mortar bed (also referred to as a cement bed or a mud bed) that extends the length of the linear drain channel 701, and by backfilling the underside of the linear drain channel 701.

As described above, due to the semi-round shape of the semi round drain body 100 according to exemplary embodiments of the present invention, the semi-round drain body 100 may be placed closer to a structure such as, for example, a wall or the threshold to a shower enclosure, compared to a conventional fully round drain body. When used in the linear drain system 700 with the linear drain channel 701, the semi-round drain body 100 provides additional improvements compared to a conventional linear drain system. For example, since the semi-round drain body 100 may be placed closer to such a structure, the linear drain channel 701 installed onto the semi-round drain body 100 may also be placed closer to the structure. That is, the linear drain channel 701 in the linear drain system 700 according exemplary embodiments may be placed closer to a structure such as a wall or the threshold to a shower enclosure relative to a linear drain channel in a conventional linear drain system due to the semi-round shape of the semi-round drain body 100. In addition, due to the semi-round shape of the semi-round drain body 100, the width of the linear drain channel 701 between the first and second sides 702 and 703 may be smaller than the width of a conventional linear drain channel used with a conventional fully round drain body. Thus, exemplary embodiments allow for a smaller linear drain channel 701. As a result, exemplary embodiments of the linear drain system 700 provide improvements relating to the efficiency of drainage in certain environments, and may also provide the benefit of giving an installer more options regarding the placement of the linear drain channel 701.

For example, according to exemplary embodiments, the distance between the first side 702 of the linear drain channel 701 and the second side 703 of the linear drain channel 701 is about equal to the distance between the first straight edge 103 of the semi-round drain body 100 and the second straight edge 104 of the semi-round drain body 100. That is, the width of the linear drain channel 701 measured from the first side 702 to the second side 703 is about equal to the width of the semi-round drain body 100 measured from the first straight edge 103 to the second straight edge 104. As a result, the linear drain channel 701 may be installed closer to a structure such as, for example, a wall or a threshold to a shower enclosure compared to a conventional linear drain channel in a conventional linear drain system that utilizes a conventional fully round drain body.

In exemplary embodiments, when the semi-round drain body 100 is attached to the linear drain channel 701, the first side 702 of the linear drain channel 701 is substantially aligned with the first straight edge 103 of the semi-round drain body 100, and/or the second side 703 of the linear drain channel 701 is substantially aligned with the second straight edge 104 of the semi-round drain body 100. As a result, the linear drain channel 701 may be installed closer to a structure such as, for example, a wall or a threshold to a shower enclosure compared to a conventional linear drain channel in a conventional linear drain system that utilizes a conventional fully round drain body.

In exemplary embodiments, when the semi-round drain body 100 is attached to the linear drain channel 701, the first straight edge 103 of the semi-round drain body 100 does not extend beyond the first side 702 of the linear drain channel in a top plan view, and/or the second straight edge 104 of the semi-round drain body 100 does not extend beyond the second side 703 of the linear drain channel 701 in a top plan view. As a result, the linear drain channel 701 may be installed closer to a structure such as, for example, a wall or a threshold to a shower enclosure compared to a conventional linear drain channel in a conventional linear drain system that utilizes a conventional fully round drain body.

The above-described configurations can be seen, for example, in FIG. 7, in which the first and second straight edges 103 and 104 of the semi-round drain body 100 are not visible in the top plan view due to them being covered by the first and second sides 702 and 703 of the linear drain channel 701, as well as in FIGS. 8 and 9.

In addition to allowing for a linear drain channel to be placed closer to a structure such as a wall or the threshold of a shower enclosure, the semi-round shape of the semi-round drain body 100 according to exemplary embodiments of the present invention allows for any type of floor drain connected thereto to be placed closer to such a structure as compared to a conventional drain body.

Having described exemplary embodiments fix a semi-round drain body and a linear drain system including the same, it is noted that modifications and variations can be made by persons skilled in the art in light of the above teachings. It is therefore to be understood that changes may be made in exemplary embodiments of the invention, which are within the scope and spirit of the invention as defined by the appended claims. Having thus described the invention with the details and particularity required by the patent laws, what is claimed and desired protected by Letters Patent is set forth in the appended claims.

What is claimed is:

1. A semi-round drain body, comprising:

an upper surface;

a clamping plate configured to attach to the upper surface; and a drain hole extending through the upper surface, wherein the upper surface comprises:

a first straight edge;

a second straight edge disposed opposite to the first straight edge, wherein the drain hole is disposed between the first and second straight edges;

a first curved edge; and a second curved edge disposed opposite to the first curved edge, wherein the drain hole is disposed between the first and second curved edges, wherein the first curved edge connects a first end of the first straight edge and a first end of the second straight edge to each other, and the second curved edge connects a second end of the first straight edge and a second end of the second straight edge to each other, wherein the first curved edge, the second curved edge, the first straight edge and the second straight edge extend upward from the upper surface to form a semi-round lip, a size and a shape of the clamping plate in a plan view correspond to a size and a shape of the semi-round lip in the plan view, and the clamping plate fits within the semi-round lip upon being attached to the upper surface.

2. The semi-round drain body of claim 1, further comprising:

a base portion connected to a bottom side of the upper surface, wherein the drain hole and the base portion form a through hole extending through the semi-round drain body.

3. The semi-round drain body of claim 2, wherein the base portion has a circular shape.

4. The semi-round drain body of claim 3, further comprising:

a fastener opening formed in the clamping plate, wherein the fastener opening is shaped and dimensioned to receive a fastener; and a fastener receiving cavity disposed below and extending from the bottom side of the upper surface, wherein the fastener receiving cavity is aligned with the fastener opening when the clamping plate is attached to the upper surface, and the fastener receiving cavity is configured to secure the fastener, wherein the fastener receiving cavity is disposed in an area between the first end of the first straight edge and a center of the first curved edge.

5. The semi-round drain body of claim 4, wherein the fastener receiving cavity is disposed between an outer circumference of the base portion and the first curved edge.

6. The semi-round drain body of claim 4, wherein the fastener is a screw or a bolt.

7. The semi-round drain body of claim 3, further comprising:

a first fastener opening formed in the clamping plate, wherein the first fastener opening is shaped and dimensioned to receive a first fastener;

a first fastener receiving cavity disposed below and extending from the bottom side of the upper surface, wherein the first fastener receiving cavity is aligned with the first fastener opening when the clamping plate is attached to the upper surface, is configured to secure the first fastener, and is disposed in a first area between the first end of the first straight edge and a center of the first curved edge;

a second fastener opening formed in the clamping plate, wherein the second fastener opening is shaped and dimensioned to receive a second fastener;

a second fastener receiving cavity disposed below and extending from the bottom side of the upper surface, wherein the second fastener receiving cavity is aligned with the second fastener opening when the clamping plate is attached to the upper surface, is configured to secure the second fastener, and is disposed in a second area between the first end of the second straight edge and the center of the first curved edge;

a third fastener opening formed in the clamping plate, wherein the third fastener opening is shaped and dimensioned to receive a third fastener;

a third fastener receiving cavity disposed below and extending from the bottom side of the upper surface, wherein the third fastener receiving cavity is aligned with the third fastener opening when the clamping plate is attached to the upper surface, is configured to secure the third fastener, and is disposed in a third area between the second end of the second straight edge and a center of the second curved edge; and a fourth fastener opening formed in the clamping plate, wherein the fourth fastener opening is shaped and dimensioned to receive a fourth fastener; and a fourth fastener receiving cavity disposed below and extending from the bottom side of the upper surface, wherein the fourth fastener receiving cavity is aligned with the fourth fastener opening when the clamping plate is attached to the upper surface, is configured to secure the fourth fastener, and is disposed in a fourth area between the second end of the first straight edge and the center of the second curved edge.

8. The semi-round drain body of claim 7, wherein the first and second fastener receiving cavities are disposed between an outer circumference of the base portion and the first curved edge, and the third and fourth fastener receiving cavities are disposed between the outer circumference of the base portion and the second curved edge.

9. The semi-round drain body of claim 8, wherein the first, second, third, and fourth fasteners are screws or bolts.

10. A linear drain system, comprising:

a linear drain channel, comprising:

a first side, a second side opposing the first side, a third side, and a fourth side opposing the third side, wherein the first side connects a first end of the third side and a first end of the fourth side to each other, and the second side connects a second end of the third side and a second end of the fourth side to each other, wherein the first and second sides are longer than the third and fourth sides;

a lower surface disposed between and connected to the first, second, third, and fourth sides; and a first circular drain hole formed in the lower surface; and a semi-round drain body configured to attach to the linear drain channel, comprising:

an upper surface; and a second circular drain hole extending through the upper surface, wherein the upper surface comprises:

a first straight edge;

a second straight edge disposed opposite to the first straight edge, wherein the second circular drain hole of the semi-round drain body is disposed between the first and second straight edges;

a first curved edge; and a second curved edge disposed opposite to the first curved edge, wherein the second circular drain hole of the semi-round drain body is disposed between the first and second curved edges, wherein the first curved edge connects a first end of the first straight edge and a first end of the second straight edge to each other, and the second curved edge connects a second end of the first straight edge and a second end of the second straight edge to each other, wherein, in a plan view, when the semi-round drain body is attached to the linear drain channel, the first and second circular drain holes, are aligned with each other, and a distance between the first side of the linear drain channel and the second side of the linear drain channel is about equal to a distance between the first straight edge of the semi-round drain body and the second straight edge of the semi-round drain body.

11. The linear drain system of claim 10, wherein, when the semi-round drain body is attached to the linear drain channel, the first side of the linear drain channel is substantially aligned with the first straight edge of the semi-round drain body in the plan view.

12. The linear drain system of claim 10, wherein, when the semi-round drain body is attached to the linear drain channel, the first straight edge of the semi-round drain body does not extend beyond the first side of the linear drain channel in the plan view.

13. The linear drain system of claim 10, further comprising:

an outlet, wherein the outlet attaches the semi-round drain body to the linear drain channel, wherein the first drain hole of the linear drain channel, the second drain hole of the semi-round drain body, and the outlet form a through hole.

14. The linear drain system of claim 10, wherein the semi-round drain body further comprises:

a fastener opening formed in the clamping plate, wherein the fastener opening is shaped and dimensioned to receive a fastener; and a fastener receiving cavity disposed below and extending from a bottom side of the upper surface, wherein the fastener receiving cavity is aligned with the fastener opening when the clamping plate is attached to the upper surface, and the fastener receiving cavity is configured to secure the fastener, wherein the fastener receiving cavity is disposed in an area between the first end of the first straight edge and a center of the first curved edge.

15. A linear drain system, comprising:

a linear drain channel, comprising:

a first side;

a second side disposed substantially parallel to the first side;

a third side; and a fourth side disposed substantially parallel to the third side, wherein the first and second sides are longer than the third and fourth sides; and a semi-round drain body configured to attach to the linear drain channel, comprising:

an upper surface comprising:

a first straight edge;

a second straight edge disposed substantially parallel to the first straight edge;

a first curved edge; and a second curved edge disposed opposite to the first curved edge wherein in a plan view, when the semi-round drain body is attached to the linear drain channel, a circular drain hole of the semi-round drain body is aligned with a circular drain hole of the linear drain channel, and the first side of the linear drain channel is substantially aligned with the first straight edge of the semi-round drain body.

16. The linear drain system of claim 15, wherein, when the semi-round drain body is attached to the linear drain channel, a distance between the first side of the linear drain channel and the second side of the linear drain channel is about equal to a distance between the first straight edge of the semi-round drain body and the second straight edge of the semi-round drain body in the plan view.

17. The linear drain system of claim 15, wherein, when the semi-round drain body is attached to the linear drain channel, the first straight edge of the semi-round drain body does not extend beyond the first side of the linear drain channel in the plan view.

18. The linear drain system of claim 15, wherein the semi-round drain body further comprises:

a fastener opening formed in the clamping plate, wherein the fastener opening is shaped and dimensioned to receive a fastener; and a fastener receiving cavity disposed below and extending from a bottom side of the upper surface, wherein the fastener receiving cavity is aligned with the fastener opening when the clamping plate is attached to the upper surface, and the fastener opening is configured to secure the fastener, wherein the fastener receiving cavity is disposed in an area between a first end of the first straight edge and a center of the first curved edge.

* * * * *